US011114061B2

(12) United States Patent
Gao et al.

(10) Patent No.: US 11,114,061 B2
(45) Date of Patent: Sep. 7, 2021

(54) LIGHT-EMISSION CONTROL SIGNAL GENERATING DEVICE AND DISPLAY DEVICE

(71) Applicant: BOE TECHNOLOGY GROUP CO., LTD., Beijing (CN)

(72) Inventors: Xueling Gao, Beijing (CN); Kuanjun Peng, Beijing (CN); Chengchung Yang, Beijing (CN); Zhiqiang Xu, Beijing (CN); Wei Qin, Beijing (CN); Tieshi Wang, Beijing (CN); Xiaolong Li, Beijing (CN); Shengnan Li, Beijing (CN); Wanpeng Teng, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 12 days.

(21) Appl. No.: 16/623,609

(22) PCT Filed: May 24, 2019

(86) PCT No.: PCT/CN2019/088422
§ 371 (c)(1),
(2) Date: Dec. 17, 2019

(87) PCT Pub. No.: WO2019/228282
PCT Pub. Date: Dec. 5, 2019

(65) Prior Publication Data

US 2021/0142764 A1 May 13, 2021

(30) Foreign Application Priority Data

May 31, 2018 (CN) ..... 201810553993.3

(51) Int. Cl.
*G09G 5/10* (2006.01)
*G09G 3/3275* (2016.01)

(52) U.S. Cl.
CPC ..... *G09G 5/10* (2013.01); *G09G 3/3275* (2013.01); *G09G 2320/0646* (2013.01)

(58) Field of Classification Search
CPC ..... G09G 5/10
See application file for complete search history.

(56) References Cited

U.S. PATENT DOCUMENTS 6,989,845 B1 1/2006 Okamoto et al.
2001/0030513 A1 10/2001 Takada et al.
(Continued)

FOREIGN PATENT DOCUMENTS

CN 1655024 8/2005
CN 101034532 9/2007
(Continued)

OTHER PUBLICATIONS

International Search Report and Written Opinion dated Aug. 9, 2019 for PCT Patent Application No. PCT/CN2019/088422.
(Continued)

*Primary Examiner* — Gustavo Polo
(74) *Attorney, Agent, or Firm* — Thomas | Horstemeyer, LLP

(57) ABSTRACT

The present disclosure relates to a light-emission control signal generating device and a display device. The light-emission control signal generating device includes: a state detection circuit configured to detect whether a current frame is a static frame or a dynamic frame and output an indication signal indicating the static frame or the dynamic frame; and a plurality of light emission control signal generation circuits; wherein the plurality of light emission control signal generation circuits are divided into a plurality of blocks, and individual blocks are input with different light emission enable signals based on the indication signal to generate light emission control signals.

13 Claims, 18 Drawing Sheets

(56) References Cited

U.S. PATENT DOCUMENTS

| | | | | |
|---|---|---|---|---|
| 2003/0174150 | A1* | 9/2003 | Ohe | G09G 3/2022 345/690 |
| 2010/0085386 | A1* | 4/2010 | Lin | G09G 3/3611 345/690 |

FOREIGN PATENT DOCUMENTS

| | | | |
|---|---|---|---|
| CN | 100543821 | | 9/2009 |
| CN | 101727815 | A | 6/2010 |
| CN | 102214427 | | 10/2011 |
| CN | 101727815 | B | 4/2012 |
| CN | 102402939 | | 4/2012 |
| CN | 102402941 | | 4/2012 |
| CN | 103310738 | | 9/2013 |
| CN | 104123906 | | 10/2014 |
| CN | 108470540 | | 8/2018 |
| CN | 108550347 | | 9/2018 |
| CN | 108564919 | | 9/2018 |
| JP | 2001083926 | | 3/2001 |
| JP | 449334 | | 4/2010 |

OTHER PUBLICATIONS

1st Office Action dated Aug. 1, 2019 for Chinese Patent Application No. 201810553993.3.

2nd Office Action dated May 11, 2020 for Chinese Patent Application No. 201810553993.3.

* cited by examiner

LIGHT-EMISSION CONTROL SIGNAL GENERATING DEVICE AND DISPLAY DEVICE

CROSS-REFERENCE TO RELATED APPLICATIONS

This application is a § 371 national phase application of PCT Patent Application No. PCT/CN2019/088422, filed May 24, 2019 which is based upon, claims the benefit of, and claims priority to Chinese Patent Application No. 201810553993.3, filed on May 31, 2018, the entire contents of both of which being incorporated herein by reference.

TECHNICAL FIELD

The present disclosure relates to display technologies and, in particular, to a light emission control signal generation device and a display device.

BACKGROUND

Although current light emitting devices have a fast response speed, they also have the problem of blur when a moving object is displayed. This is due to the combined effect of the holding characteristics of the light emitting device and the visual persistence characteristics of the human eye. As shown in FIG. 1, a square waveform light intensity signal is input to the human eye, and the human visual response will be delayed (the visual persistence time of normal human eyes is 0.05~0.1 s).

It is assumed that a screen displays a picture that moves quickly from left to right, and what the human eye observes is a blurred picture, as shown in FIG. 2.

Taking AMOLED (Active-matrix organic light emitting diode) as an example, AMOLED is a hold-type display technology. When an object moves on the screen, the perception that the human eye generates in the brain after seeing the image is different from the movement position of the object displayed on the screen, and as a result, the brain will has a feeling of smear and blur. FIG. 3 shows the principle of generating a blur feeling in the brain. The movement is as shown in A) of FIG. 3, and what it should be displayed on the display is shown in B) of FIG. 3. However, the actual situation is not the case, and what it is displayed on the display in the actual situation is shown in C) of FIG. 3. As can be seen from D) of FIG. 3, there is a difference between the position of the object determined by eye tracking and the position of the object actually displayed on the display, which leads to a blur.

Therefore, how to effectively solve the dynamic smear in the existing display devices is an urgent problem.

It should be noted that the information disclosed in the Background section above is only for enhancing the understanding of the background of the present disclosure, and thus may include information that does not constitute prior art known to those of ordinary skill in the art.

SUMMARY

Embodiments of the present disclosure provide a light emission control signal generation device and a display device.

According to an aspect of the present disclosure, a light emission control signal generation device is provided, including:

a state detection circuit configured to detect whether a current frame is a static frame or a dynamic frame and output an indication signal indicating the static frame or the dynamic frame, respectively; and a plurality of light emission control signal generation circuits;

wherein the plurality of light emission control signal generation circuits are divided into a plurality of blocks, and individual blocks are input with different light emission enable signals based on the indication signal to generate light emission control signals.

An embodiment of the present disclosure further provides a display panel including a pixel array formed by a plurality of rows of pixel units and a light emission control signal generation circuit corresponding to individual rows of pixel units;

wherein:

the pixel array comprises a plurality of partitions, each partition comprising a plurality of pixel unit groups, each pixel unit group comprising a part of pixel units in a row of pixel units;

each pixel unit group comprises a third switching transistor and a fourth switching transistor:

a gate of the third switching transistor is input with a first control signal, a source of the third switching transistor is input with a light emission control signal, and a drain of the third switching transistor is connected to pixel units in each pixel unit group; and a gate of the fourth switching transistor is input with a second control signal, a source of the fourth switching transistor is connected to the pixel units in each pixel unit group, and a drain of the fourth switching transistor is input with a modulated light emission control signal.

a duty ratio of the modulated light emission control signal is smaller than a duty ratio of the light emission control signal.

An embodiment of the present disclosure further provides a display device, including the light emission control signal generation device as described above.

In the embodiments of the present disclosure, the plurality of light emission control signal generation circuits are divided into different blocks, and each block can be input a different light emission enable signal based on the indication signal which is output by the state detection circuit and indicates whether the current frame is the static frame or the dynamic frame, so that each block is input with different light emission enable signal based on the indication signal to generate light emission control signals. In this way, a corresponding light emission enable signal can be input in the case of the dynamic frame, thereby changing the light emission time of the light emitting device to improve the dynamic smear.

DETAILED DESCRIPTION

Figure 1:
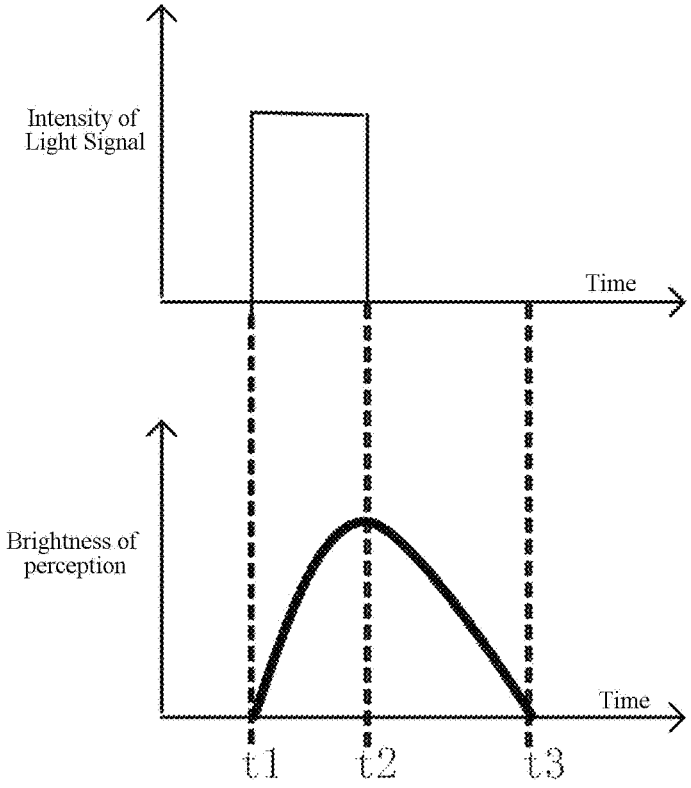
FIG. 1 shows an example of a human visual response.
Figure 2:
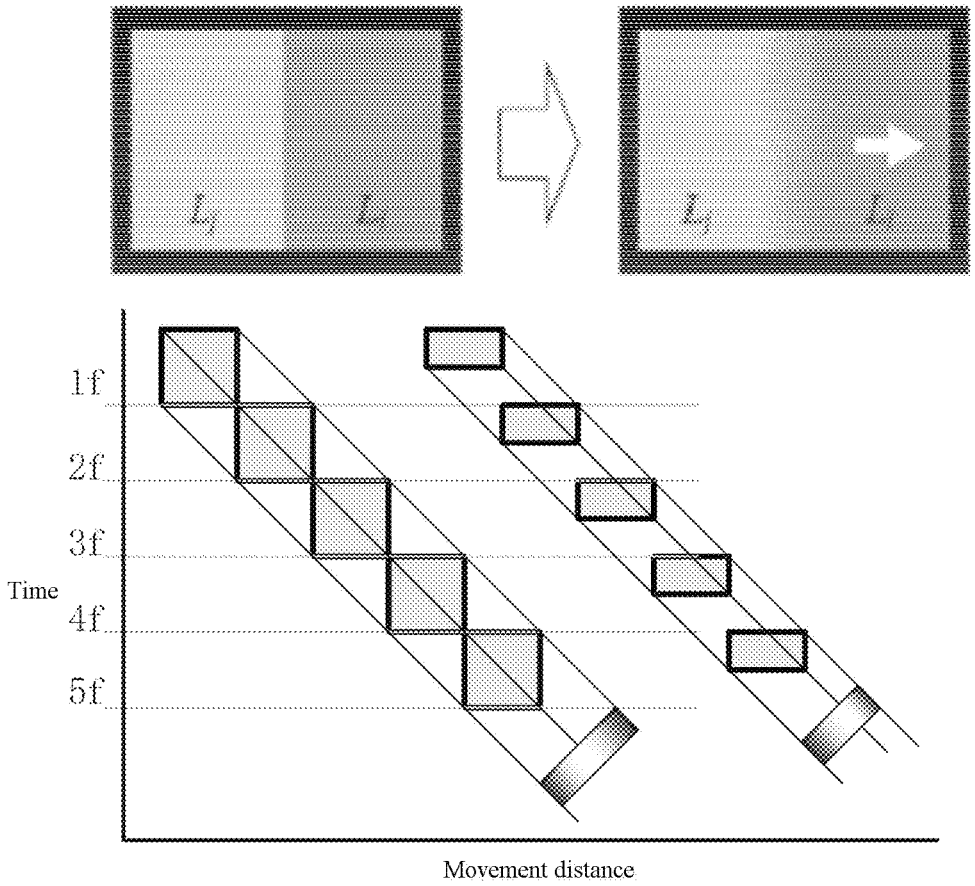
FIG. 2 shows a blur phenomenon observed by a human eye.
Figure 3:
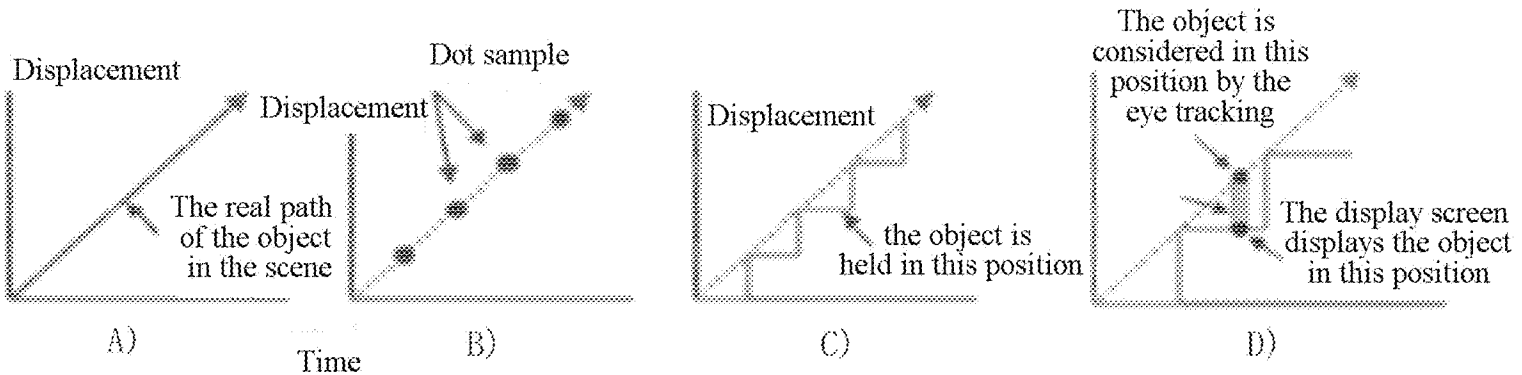
FIG. 3 shows a schematic diagram illustrating a reason why a human brain feels smear and blur.

Example embodiments will now be described more fully with reference to the accompanying drawings. However, the embodiments can be implemented in a variety of forms and should not be construed as being limited to the examples set forth herein; rather, these embodiments are provided so that this disclosure will be more complete so as to convey the idea of the exemplary embodiments to those skilled in this art. The described features, structures, or characteristics in one or more embodiments may be combined in any suitable manner. However, one skilled in the art will appreciate that the technical solutions of the present disclosure can be practiced when one or more of the described specific details may be omitted or other methods, components, devices, steps, etc. may be employed. In other cases, well-known technical solutions are not shown or described in detail to avoid obscuring aspects of the present disclosure.

In addition, the drawings are merely schematic representations of the present disclosure and are not necessarily drawn to scale. The same reference numerals in the drawings denote the same or similar parts, and the repeated description thereof will be omitted.

Figure 4:
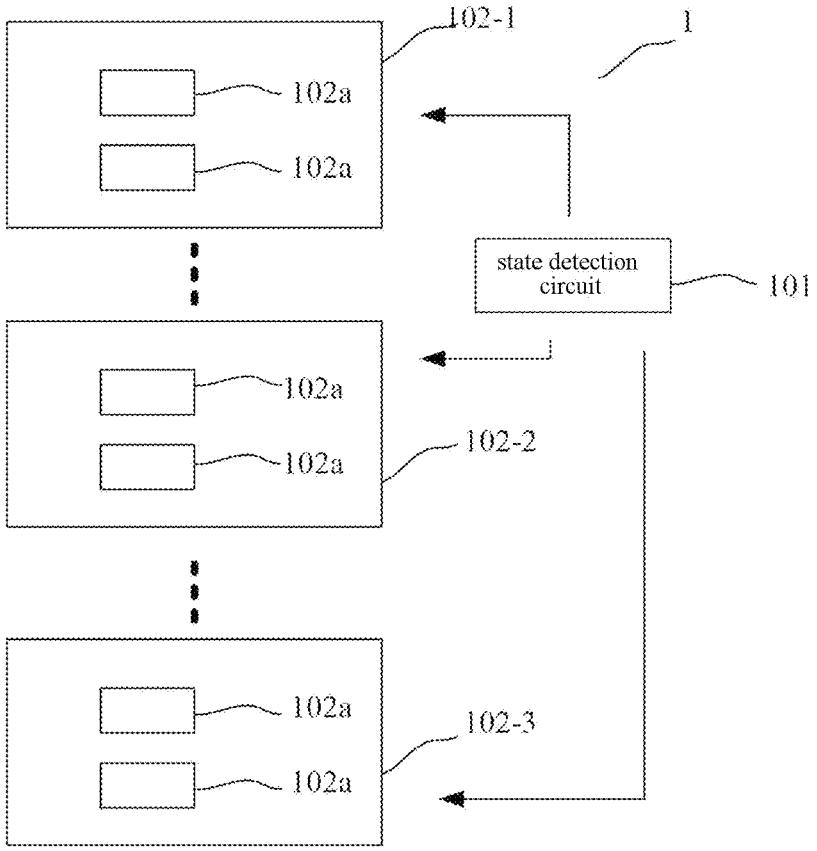
FIG. 4 shows a schematic structural diagram of a light emission control signal generation device according to an exemplary embodiment of the present disclosure.

FIG. 4 shows a schematic structural diagram of a light emission control signal generation device according to an exemplary embodiment of the present disclosure. The light emission control signal generation device 1 includes a state detection circuit 101 and a plurality of light emission control signal generation circuits 102*a*. The plurality of light emission control signal generation circuits 102*a* are divided into a plurality of blocks, for example, blocks 102-1 to 102-3, and individual blocks are input with different light emission enable signals based on the indication signal to generate light emission control signals.

According to an embodiment, the state detection circuit 101 may be implemented by various devices capable of realizing the current frame state. For example, the state detection circuit 101 may be implemented by a digital device or by an analog device. For example, the state detector 101 may be implemented by an integrated circuit (IC).

In the embodiment of the present disclosure, the plurality of light emission control signal generation circuits are divided into different blocks, and each block can be input with a different light emission enable signal based on the indication signal which is output by the state detection circuit to indicate whether the current frame is the static frame or the dynamic frame, so that each block is input with a different light emission enable signal based on the indication signal to generate light emission control signals. In this way, a corresponding light emission enable signal can be input in the case of the dynamic frame, thereby changing the light emission time of the light emitting device to improve the dynamic smear.

Embodiment 1

Figure 5:
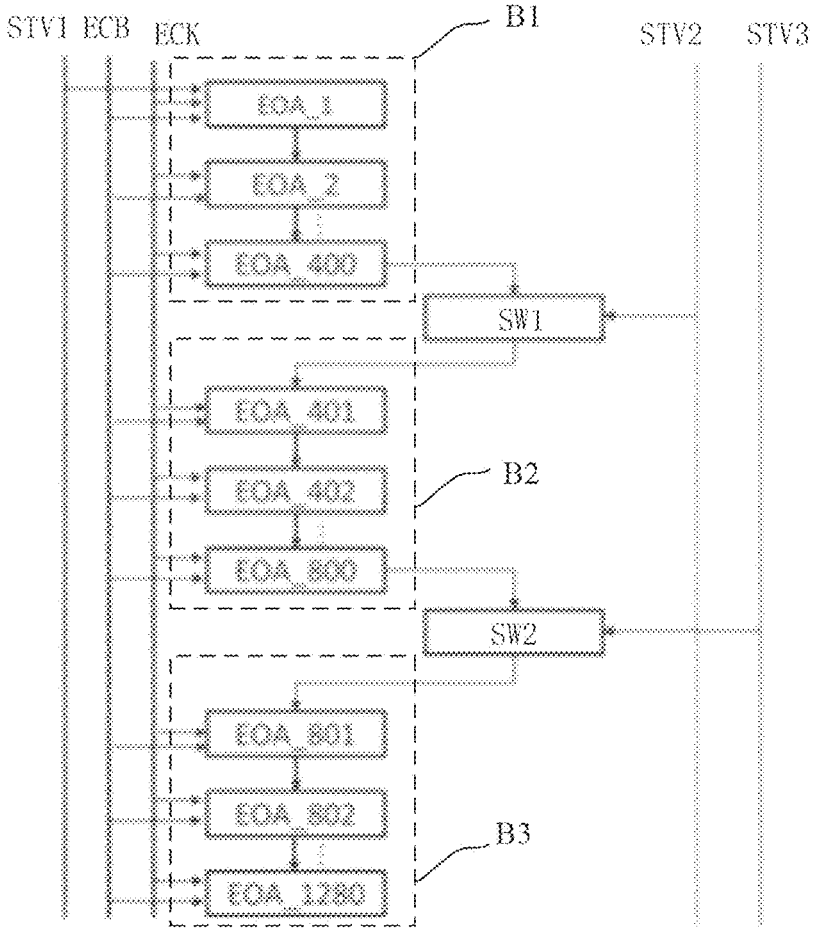
FIG. 5 shows a schematic structural diagram of a light emission control signal generation device according to an exemplary embodiment of the present disclosure.

FIG. 5 shows a schematic structural diagram of a light emission control signal generation device of an embodiment of the present disclosure. In this embodiment, 1280 emission control signal generation circuits are shown, that is, EOA_1 to EOA_1280. These emission control signal generation circuits are divided into a plurality of blocks. For example, EOA_1 to EOA_400 form a first block B1, EOA_401 to EOA_800 form a second block B2, and EOA_801 to EOA_1280 forms a third block B3. Of course, the block division manner given in the figure is only an example, and a plurality of light emission control signal generation circuits may be divided into different numbers of blocks according to actual requirements.

Two adjacent blocks are connected through a switching circuit, and the switching circuit is configured to input a first light emission enable signal or a second light emission enable signal to one of the two adjacent blocks based on the indication signal output by the state detection circuit (not shown in the figure).

As shown in FIG. 5, a switching circuit SW1 is connected between the first block B1 and the second block B2, and the switching circuit SW1 selectively inputs the first light emission enable signal STV1 or the second light emission enable signal STV2 to the second Block B2.

A switching circuit SW2 is connected between the second block B2 and the third block B3. The switching circuit SW2 selectively inputs the first light emission enable signal STV1 or another second light emission enable signal STV3 to the third block B3.

According to an exemplary embodiment, the light emission control signal generation circuits EOA_1 to EOA_1280 may be implemented by transistors. The light emission control signal generation circuits EOA_1 to EOA_1280 may be integrated in a driving circuit of a display device.

Figure 6:
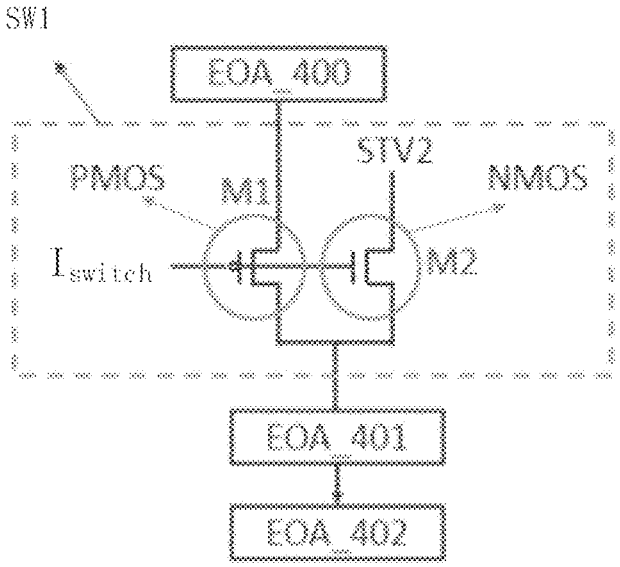
FIG. 6 shows a schematic structural diagram of a switching circuit in FIG. 5.

FIG. 6 shows a schematic structural diagram of a switching circuit in FIG. 5. The switching circuit includes a first switching transistor M1 and a second switching transistor M2.

A gate of the first switching transistor M1 is input with the indication signal (indicated by Iswjtch in the figure) output by the state detection circuit, a source of the first switching transistor M1 is connected to one of the two adjacent blocks, for example, to the last light emission control signal generation circuit EOA_400 in the first block B1. A drain of the first switching transistor M1 is connected to the other one in the two adjacent blocks, for example, to the first light emission control signal generation circuit EOA_401 in the second block B2.

A gate of the second switching transistor M2 is input with the indication signal Iswitch, the source of the second switching transistor M2 is input with the second light emission enable signal STV2, and the drain of the second switching transistor M2 is connected to the other one of the two adjacent blocks, for example, to the first light emission control signal generation circuit EOA_401 in the second block B2.

In this embodiment, the first switching transistor M1 is a P-type transistor, and the second transistor M2 is an N-type transistor. Of course, according to specific application scenarios or design requirements, the conductivity types of the first and second switching transistors may also be changed.

The operating principle of this embodiment is described in detail below.

Figure 7:
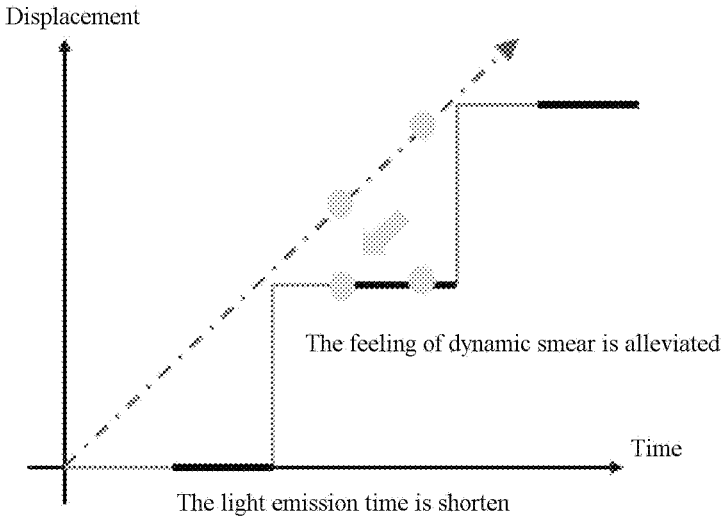
FIG. 7 shows a relationship between light emission time and brain perception.

FIG. 7 shows a relationship between light emission time and brain perception. As can be seen from the figure, the light emission time of the pixel unit (the light emitting device) is reduced, the difference between the position of the object that the human eye sees on the screen and the perception in the brain decreases. With the relationship shown in FIG. 7, for the dynamic frame, the difference the human brain perceives is reduced by reducing the light emission time, thereby eliminating the dynamic smear.

Figure 8:
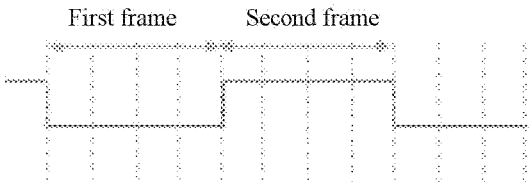
FIG. 8 shows a timing of an indication signal output by a state detection circuit.

FIG. 8 shows a timing of an indication signal output by a state detection circuit. It can be seen that when the current frame is the dynamic frame or a static frame, levels of the indication signals are different.

Figure 9:
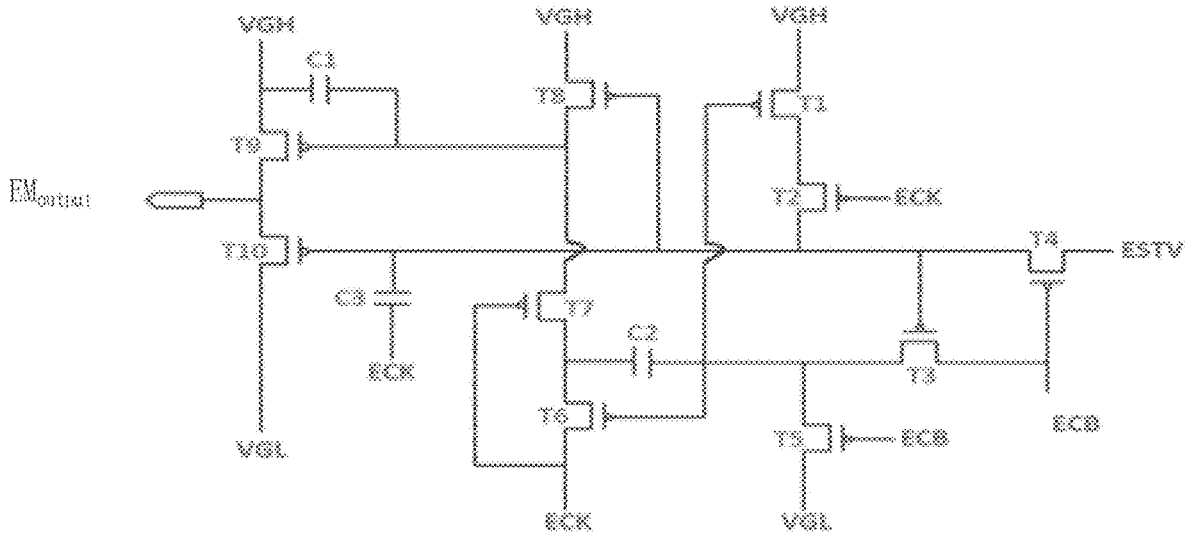
FIG. 9 shows a schematic structural diagram of each light emission control signal generation circuit.

FIG. 9 shows a schematic structural diagram of each light emission control signal generation circuit. As shown, each light emission control signal generation circuit includes ten transistors and three capacitors. $EM_{output}$ represents an output signal of each light emission control signal generation circuit, and the output signal can be input to the gates of a row of pixel units to make the row of pixel units emit light.

Figure 10:
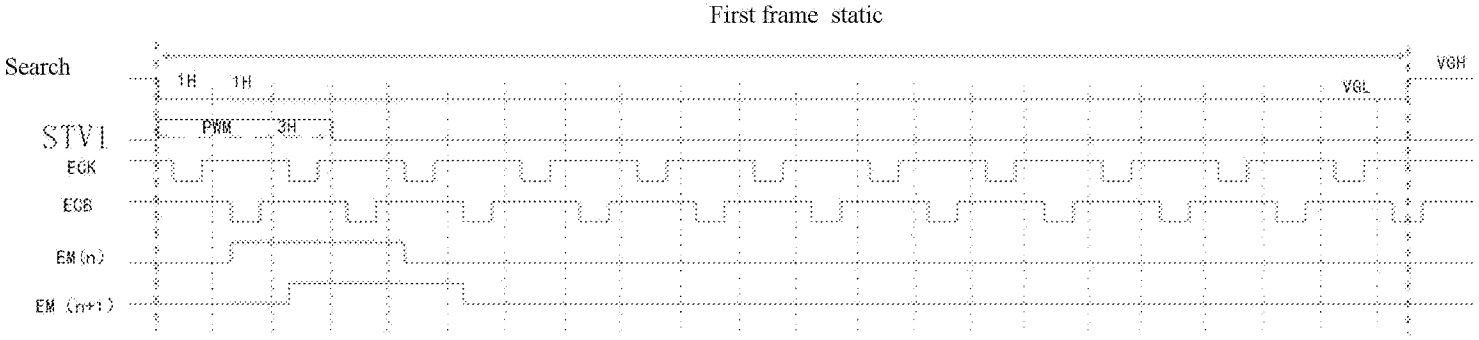
FIG. 10 shows a timing chart when a static frame is displayed.

FIG. 10 shows a timing chart when a static frame is displayed. With reference to FIGS. 6 to 10, STV1 (Start vertical) is an input signal input to each light emission control signal generation circuit, STV1 is equivalent to a frame start signal of each frame; EM (n) is a signal output from each light emission control signal generation circuit, and the EM (n) is a light emission control signal, which can control the gates of a row of pixels (such as the n-th row of pixels). The waveforms of the STV1 and EM (n) are basically the same, except that the EM (n) is delayed by a period relative to the STV1. When the current frame is a static frame, the indication signal $I_{switch}$ is at a low level, the switching transistor M1 is turned on, the transistor M2 is turned off, and the EM (n) output by the light emission control signal generation circuit EOA_400 in the first block B1 (that is, $EM_{output}$ in FIG. 8) is used as the input STV1 of the light emission control signal generation circuit EOA_401 in the next block B2. That is, in the case of the static frame, it is not necessary to adjust the light emission time of the light emitting device, and the first transistor M1 is turned on, so that each block uses the normal input signal STV1 to generate the light emission control signal.

Figure 11:
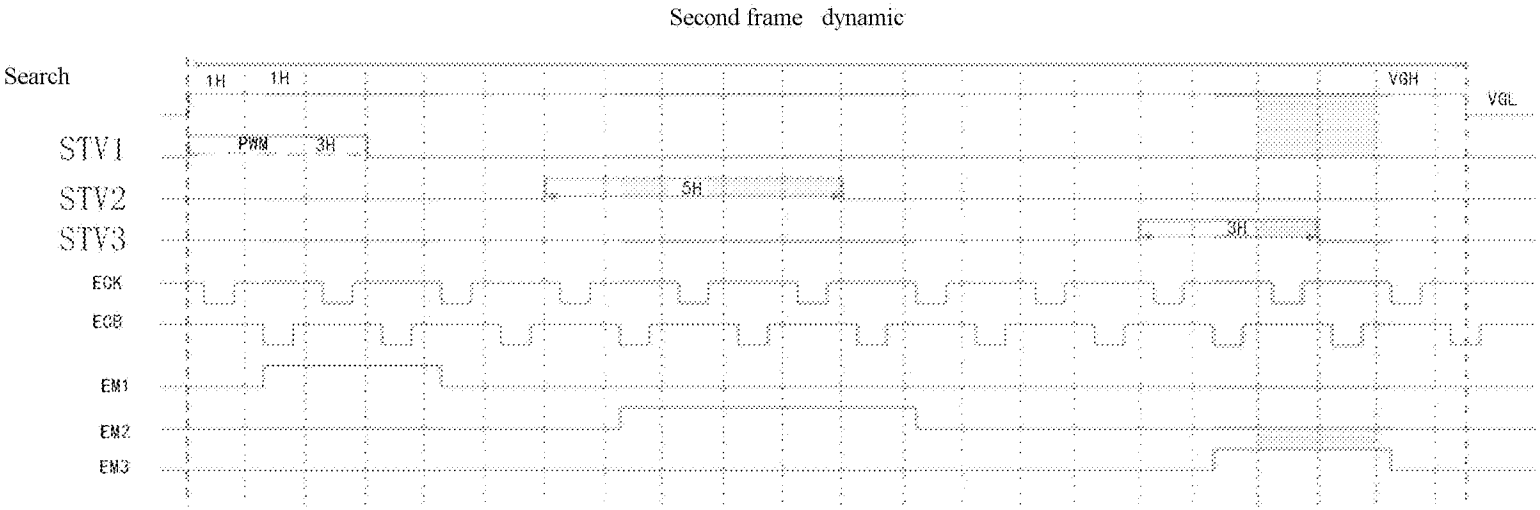
FIG. 11 shows a timing chart when a dynamic frame is displayed.

FIG. 11 shows a timing chart when a dynamic frame is displayed. With reference to FIGS. 6 to 11, when the current frame is the dynamic frame, the indication signal Iswjtch is at a high level, the switch transistor M1 is turned off and the transistor M2 is turned on, and the second light emission enable signal STV2 is input to the light emission control signal generation circuit EOA_401 in the second block B2. It can be seen from FIG. 10 that the high level of STV2 lasts for 5 clock cycles, while the high level of STV1 lasts for 3 clock cycles. By extending the high-level duration of STV2 (equivalently, the light emission enable portion of the second light emission enable signal STV2 is shorter than that of the first light emission enable signal STV1), the light emission time of the light emitting device is reduced, thereby eliminating the dynamic smear. That is, in the case of the dynamic frame, the light emission time of the light emitting device needs to be adjusted. Specifically, the light emission time of the light emitting device needs to be shortened, so that the first transistor M1 is turned off and the second transistor M2 is turned on, and the STV2 is input to the second block B2 to generate a corresponding lighting control signal.

It should be noted that, in this embodiment, the duty ratio of the high and low voltages of the first light emission enable signal STV1 or the second light emission enable signal STV2 determines the duty ratio of the light emission control signal Emission. Actually, it is the output signal Emision that ultimately controls the length of the light emission time of the light emitting device (e.g., OLED).

In this embodiment, the pixel driving circuit does not need to be partitioned on the physical layer. Instead, the plurality of light emission control signal generation circuits are controlled in a partitioned manner by the switching circuit. When the current frame displays a static picture, the normal light emission enable signal STV1 is input to the second block B2; while the current frame displays a dynamic picture, STV2 is input to the second block B2. With the above driving method and circuit, the partition control for different screen displays can be implemented to address the dynamic smear.

Embodiment 2

Figure 12:
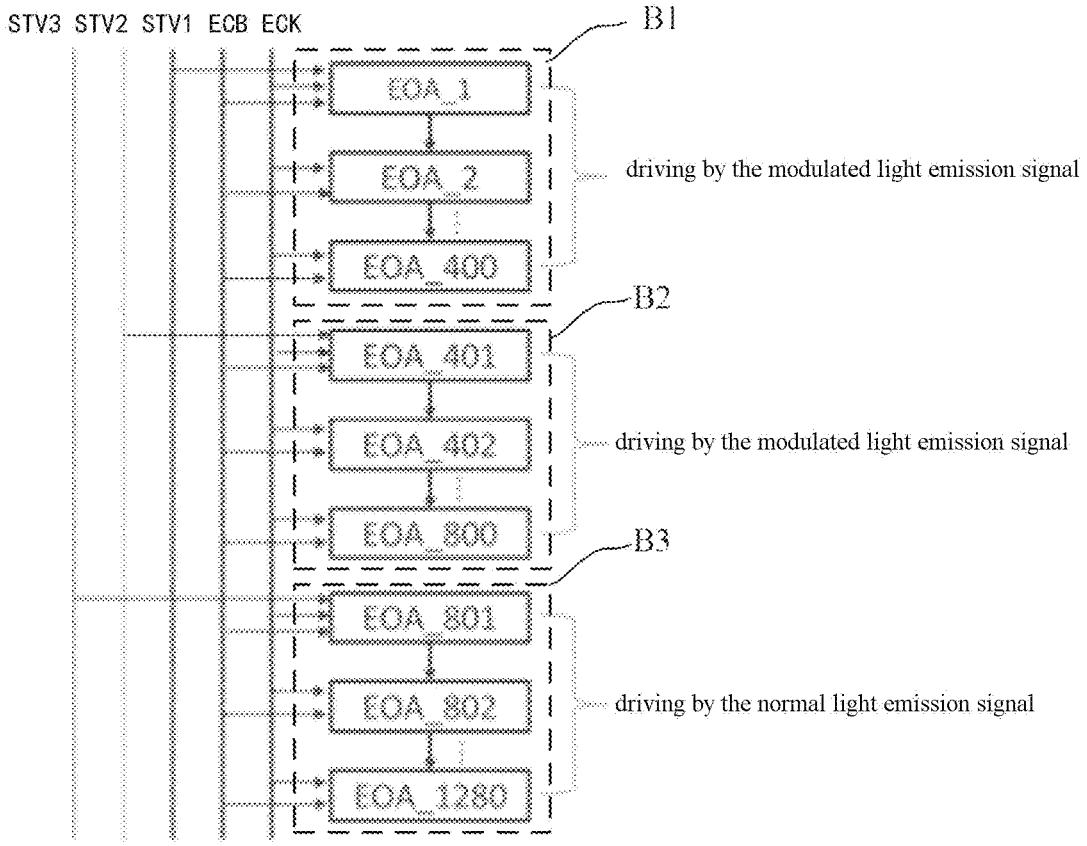
FIG. 12 shows a schematic structural diagram of a light emission control signal generation device according to an embodiment of the present disclosure.

FIG. 12 shows a schematic structural diagram of a light emission control signal generation device of an embodiment of the present disclosure. The difference between this embodiment and the embodiment shown in FIG. 5 is that there is no switching circuit in this embodiment, and there is no physical connection between the output end of one block in the plurality of blocks and the input end of the other block (see FIG. 11, there is no physical connection between the output end of the first block B1 and the input end of the second block B2, that is, there is no physical line); the blocks are driven by different light emitting signal, respectively.

Figure 13:
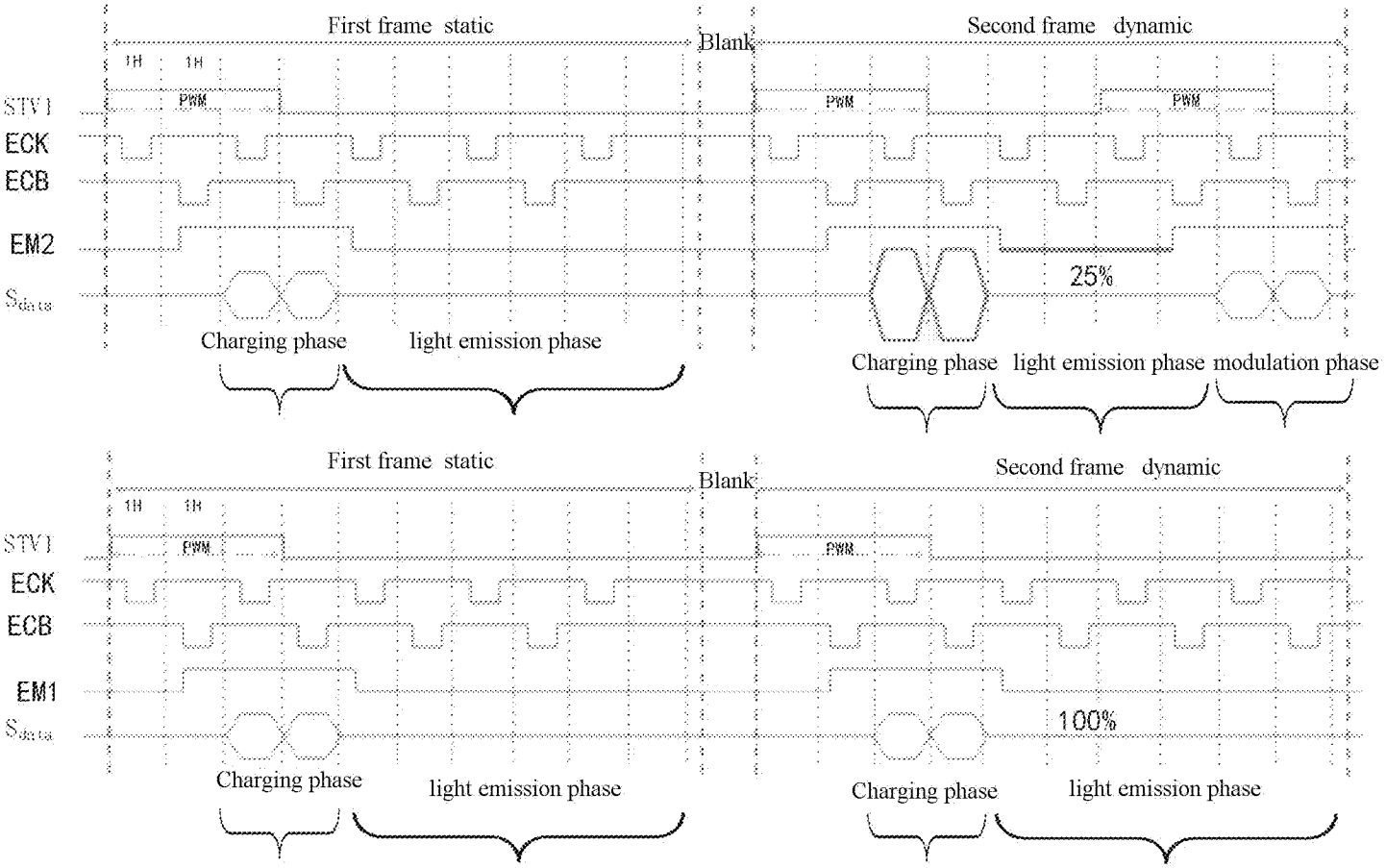
FIG. 13 shows a driving timing of the light emission control signal generation device shown in FIG. 12.

FIG. 13 shows a driving timing of the light emission control signal generation device shown in FIG. 12. The operating principle of this embodiment is described below with reference to FIGS. 12 and 13.

For the block B2, since this block corresponds to a moving object (for example, a moving point of a basketball), the modulated light emission enable signal can be used to drive this block. Referring to the upper timing in FIG. 12, for the block B2, for example, if the first frame is a static frame, the normal light emission enable signal STV1 can be used; for example, if the second frame is the dynamic frame, the modulated light emission enable signal can be used. For example, the high level of STV1 of the second frame in FIG. 13 appears again after three clock cycles, so that the duty ratio of the signal STV in the second frame is reduced, and the light emission time of light emitting device is reduced, thereby addressing the smear.

Referring to the lower timing of FIG. 13, for the blocks B1 and B3, the modulated light emission enable signal may not be used.

In addition, referring to the upper timing of FIG. 13, the level of the data signal Sdata in the charging phase of the second frame may be higher than the level of the data signal Sdata in the charging phase of the first frame.

Figure 14:
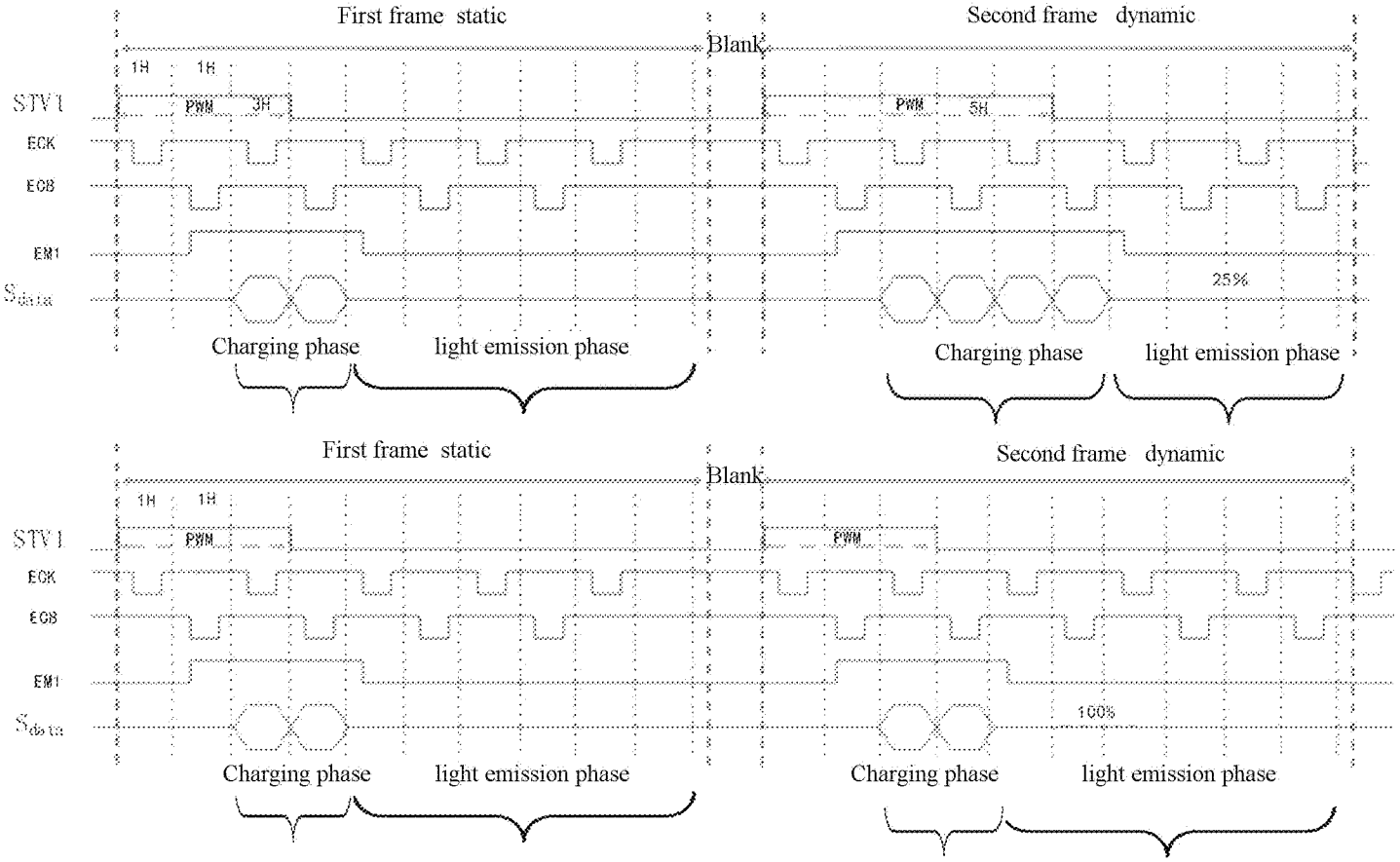
FIG. 14 shows another driving timing of the light emission control signal generation device shown in FIG. 12.

FIG. 14 shows another driving timing of the light emission control signal generation device shown in FIG. 12. The difference between this driving timing and the driving timing shown in FIG. 12 is that the duration of the high level of STV1 in the dynamic frame is longer than that of the level of STV1 in the static frame in FIG. 14, instead of reappearing the high level of STV1 every three clock cycles as shown in FIG. 13. That is, the duty ratio of the STV is reduced, and the light emission time of the light emitting device is reduced, thereby addressing the dynamic smear.

Figure 15:
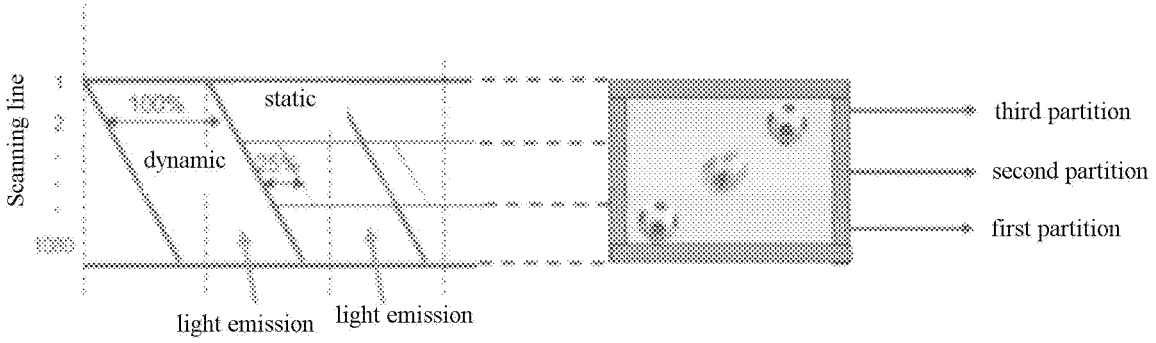
FIG. 15 shows an example of dynamic smear improvement using the device shown in FIG. 12.

FIG. 15 shows an example of dynamic smear improvement using the device shown in FIG. 12. For example, when a football is moving in the air, if the football moves to the pixel unit corresponding to the first block B1, a modulated light emission enable signal (that is, STV1 with a reduced duty ratio) can be used for the first block B1. If the football moves to the pixel unit corresponding to the second block B2, the modulated light emission enable signal can be used for the second block B2. If the football moves to the pixel unit corresponding to the third block B3, the modulated light emission enable signal can be used for the third block B3.

In this embodiment, the AMOLED display screen is divided into a plurality of regions (for example, three regions), wherein the control signal is generated by a driving chip; when it is a static picture, the duty ratio of the light emission enable signal is 100%; when it is a dynamic picture, the duty ratio of the light emission enable signal is reduced to address the dynamic smear.

Embodiment 3

Figure 16:
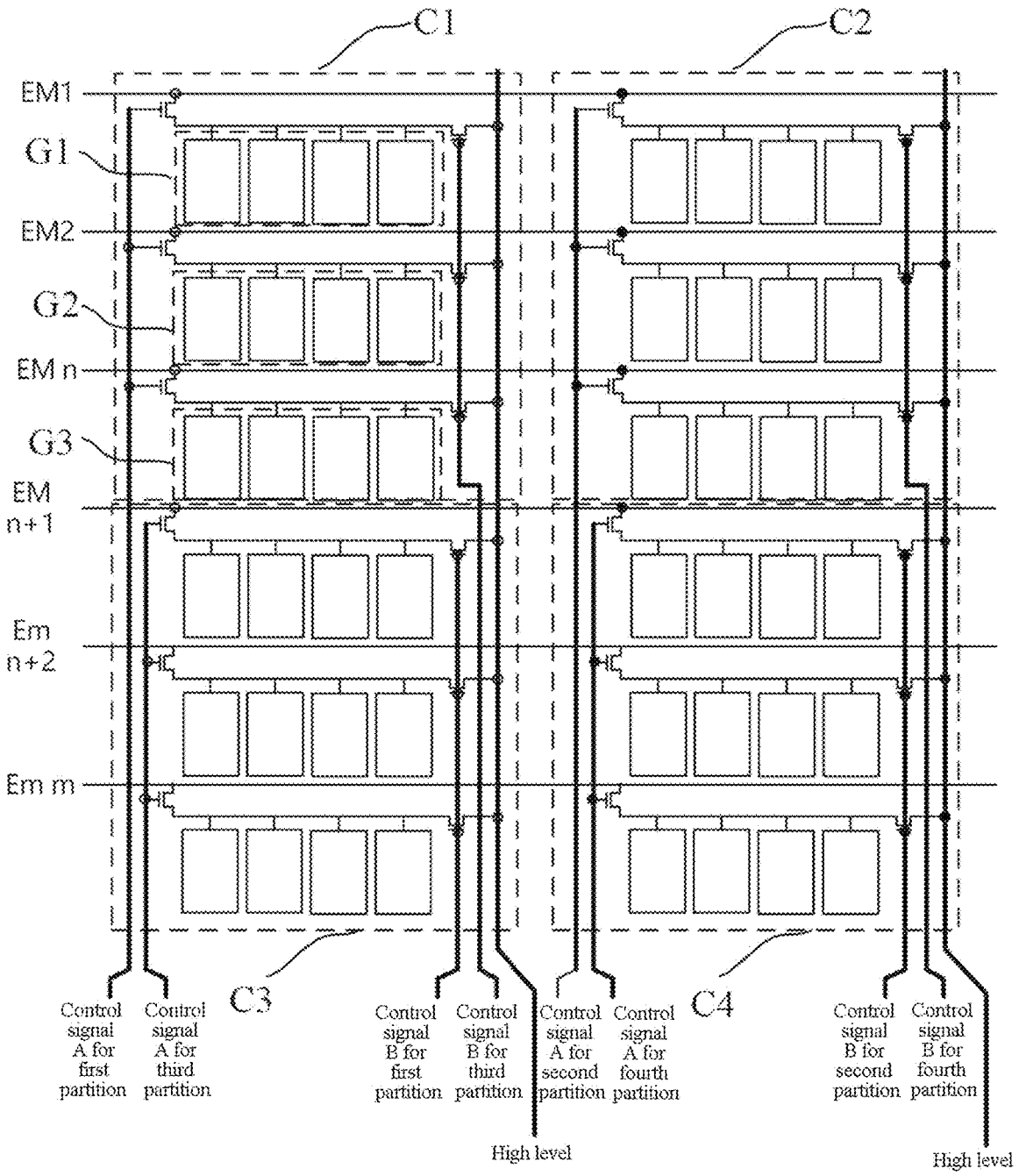
FIG. 16 shows a schematic structural diagram of a display panel according to an exemplary embodiment of the present disclosure.
Figure 17:
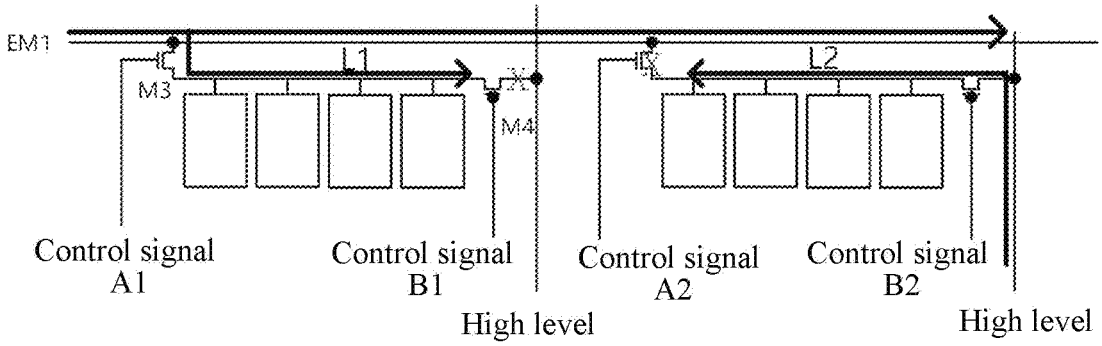
FIG. 17 shows a structure of each pixel unit group in the display panel of FIG. 16.

FIG. 16 shows a schematic structural diagram of a display panel according to an exemplary embodiment of the present disclosure. The display panel includes a pixel array formed by a plurality of rows of pixel units and light emission control signal generation circuits 301 corresponding to rows of pixel units. The pixel array includes a plurality of partitions, for example, partitions C1 to C4, and each partition includes a plurality of pixel unit groups. For example, the partition C1 includes pixel unit groups G1 to G3, and each pixel unit group includes a part of pixel units in a row of pixel units. FIG. 17 shows a structure of each pixel unit group (the structure of the pixel unit group G1 is shown in FIG. 17). Each pixel unit group includes a third switching transistor M3 and a fourth switching transistor M4.

A gate of the third switching transistor M3 is input with a first control signal A1, a source of the third switching transistor M3 is input with a light emission control signal EM1, and a drain of the third switching transistor is connected to each pixel unit in each pixel unit group (for example, four pixel units in the pixel unit group) through a line L1.

A gate of the fourth switching transistor M4 is input with a second control signal B1, a source of the fourth switching transistor is connected to each pixel unit in each pixel unit group(for example, through the line L1), and a drain of the fourth switching transistor is input with a modulated light emission control signal (for example, the high level in FIG. 17). A duty ratio of the modulated light emission control signal is smaller than that of the light emission control signal.

In another pixel unit group, the third switching transistor and the fourth switching transistor may be connected to the pixel unit through another line (such as L2 shown in FIG. 17).

Figure 18:
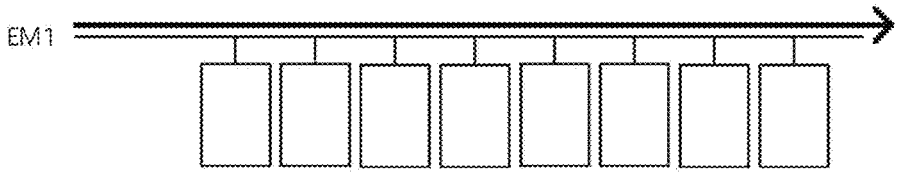
FIG. 18 shows a conventional pixel layout.

In a conventional pixel circuit, a plurality of pixel units in one row are connected to one light emission control signal line EM, as shown in FIG. 18. That is, all the pixel units in one row make the light emitting devices emit light for the same time.

In the solution of this embodiment, the pixel units are partitioned, so that the input light emission control signals in the pixel units of one row are different, so that the dynamic smear can be addressed in the case of the dynamic frame.

Referring to FIG. 17, if the current frame is a static picture, the first control signal A1 is at a low level, the second control signal B1 is at a high level, the third transistor M1 is turned on, and the fourth transistor M4 is turned off, so that the light emission control signal EM1 is input to the pixel unit group G1. That is, the normal light emission control signal is used without adjustment. If the current frame is a dynamic picture, the first control signal A1 is at a high level, the second control signal B1 is at a low level, the third transistor M1 is turned off, and the fourth transistor M4 is turned on, so that the modulated light emission control signal is input to each pixel unit in the pixel unit group G1. The duty ratio of the modulated light emission control signal can be reduced, thereby reducing the light emission time of the light emitting device and improving the dynamic smear.

In the embodiments shown in FIGS. 16 and 17, the data signal can also be adjusted by an algorithm or a process to compensate for the brightness attenuation caused by the reduction of the duty ratio of the light emission control signal. For example, in the case of the dynamic frame, the level of the data signal may be higher than the level of the data signal in the static frame during the light emitting phase, for example, see the waveforms of the data signal Sdata during the light emitting stage shown in FIG. 12 and FIG. 13.

With the solution of this embodiment, the partition control of the display screen is realized, and the dynamic smear is effectively addressed.

An embodiment of the present disclosure further provides a display device, which may include the above-mentioned light emission control signal generation device.

It should be noted that although modules or units of devices for executing functions are described above, such division of modules or units is not mandatory. In fact, features and functions of two or more of the modules or units described above may be embodied in one module or unit in accordance with the embodiments of the present disclosure. Alternatively, the features and functions of one module or unit described above may be further divided into multiple modules or units.

In addition, although the various steps of the method of the present disclosure are described in a particular order in the figures, this is not required or implied that the steps must be performed in the specific order, or all the steps shown must be performed to achieve the desired result. Additionally or alternatively, certain steps may be omitted, multiple steps may be combined into one step, and/or one step may be decomposed into multiple steps and so on.

Other embodiments of the present disclosure will be apparent to those skilled in the art. The present application is intended to cover any variations, uses, or adaptations of the present disclosure, which are in accordance with the general principles of the present disclosure and include common general knowledge or conventional technical means in the art that are not disclosed in the present disclosure. The specification and embodiments are illustrative, and the real scope and spirit of the present disclosure is defined by the appended claims.

What is claimed is:

1. A light emission control signal generation device, comprising:

a state detection circuit configured to detect whether a current frame is a static frame or a dynamic frame and output an indication signal indicating the static frame or the dynamic frame; and a plurality of light emission control signal generation circuits, wherein:

the plurality of light emission control signal generation circuits are divided into a plurality of blocks, and individual ones of the blocks are input with different light emission enable signals based on the indication signal to generate light emission control signals;

two adjacent blocks are connected through a switching circuit configured to input a first light emission enable signal or a second light emission enable signal to one of the two adjacent blocks based on the indication signal; and a light emission enable portion of the second light emission enable signal is shorter than a light emission enable portion of the first light emission enable signal.

2. The device according to claim 1, wherein the switching circuit comprises:

a first switching transistor, wherein a gate of the first switching transistor is input with the indication signal, a source of the first switching transistor is connected to one of the two adjacent blocks, and a drain of the first switching transistor is connected to the other one of the two adjacent blocks; and a second switching transistor, wherein a gate of the second switching transistor is input with the indication signal, a source of the second switching transistor is input with the second light emission enable signal, and a drain of the second switching transistor is connected to the other one of the two adjacent blocks.

3. The device according to claim 2, wherein:

if the indication signal indicates that the current frame is the dynamic frame, the first switching transistor is turned off and the second switching transistor is turned on; and if the indication signal indicates that the current frame is the static frame, the first switching transistor is turned on and the second switching transistor is turned off.

4. The device according to claim 2, wherein the first switching transistor is a P-type transistor and the second switching transistor is an N-type transistor.

5. A light emission control signal generation device, comprising:

a state detection circuit configured to detect whether a current frame is a static frame or a dynamic frame and output an indication signal indicating the static frame or the dynamic frame; and a plurality of light emission control signal generation circuits, wherein:

the plurality of light emission control signal generation circuits are divided into a plurality of blocks, and individual ones of the blocks are input with different light emission enable signals based on the indication signal to generate light emission control signals;

there is no physical connection between an output end of one of the plurality of blocks and an input end of another one of the plurality of blocks;

in response to the indication signal indicating that a frame corresponding to one of the plurality of blocks is the dynamic frame, the one of the plurality of blocks is input with a modulated driving signal;

in response to the indication signal indicating that a frame corresponding to one of the plurality of blocks is the static frame, the one of the plurality of blocks is input with a normal driving signal; and a light emission enable portion of the modulated driving signal is shorter than a light emission enable portion of the normal driving signal.

6. The device according to claim 5, wherein a level of a data signal in a charging phase corresponding to the dynamic frame is higher than a level of a data signal in a charging phase corresponding to the static frame.

7. A display panel, comprising:

a pixel array formed by a plurality of rows of pixel units and light emission control signal generation circuits corresponding to individual rows of pixel units, wherein:

the pixel array comprises a plurality of partitions, each partition comprising a plurality of pixel unit groups, each pixel unit group comprising a part of pixel units in a row of pixel units;

each pixel unit group comprises a first control switching transistor and a second control switching transistor;

a gate of the first control switching transistor is input with a first control signal, a source of the first control switching transistor is input with a light emission control signal, and a drain of the first control switching transistor is connected to pixel units in each pixel unit group;

a gate of the second control switching transistor is input with a second control signal, a source of the second control switching transistor is connected to the pixel units in each pixel unit group, and a drain of the second control switching transistor is input with a modulated light emission control signal; and a duty ratio of the modulated light emission control signal is smaller than a duty ratio of the light emission control signal.

8. A display device, comprising:

a light emission control signal generation device, wherein light emission control signal generation device comprises:

a state detection circuit configured to detect whether a current frame is a static frame or a dynamic frame and output an indication signal indicating the static frame or the dynamic frame; and a plurality of light emission control signal generation circuits, wherein:

the plurality of light emission control signal generation circuits are divided into a plurality of blocks, and individual ones of the blocks are input with different light emission enable signals based on the indication signal to generate light emission control signals;

two adjacent blocks are connected through a switching circuit;

the switching circuit is configured to input a first light emission enable signal or a second light emission enable signal to one of the two adjacent blocks based on the indication signal; and a light emission enable portion of the second light emission enable signal is shorter than a light emission enable portion of the first light emission enable signal.

9. The display device according to claim 8, wherein the switching circuit comprises:

a first switching transistor, wherein a gate of the first switching transistor is input with the indication signal, a source of the first switching transistor is connected to one of the two adjacent blocks, and a drain of the first switching transistor is connected to the other one of the two adjacent blocks; and a second switching transistor, wherein a gate of the second switching transistor is input with the indication signal, a source of the second switching transistor is input with the second light emission enable signal, and a drain of the second switching transistor is connected to the other one of the two adjacent blocks.

10. The display device according to claim 9, wherein:

if the indication signal indicates that the current frame is the dynamic frame, the first switching transistor is turned off and the second switching transistor is turned on; and if the indication signal indicates that the current frame is the static frame, the first switching transistor is turned on and the second switching transistor is turned off.

11. The display device according to claim 9, wherein the first switching transistor is a P-type transistor and the second switching transistor is an N-type transistor.

12. A display device, comprising:

a light emission control signal generation device, wherein light emission control signal generation device comprises:

a state detection circuit configured to detect whether a current frame is a static frame or a dynamic frame and output an indication signal indicating the static frame or the dynamic frame; and a plurality of light emission control signal generation circuits, wherein:

the plurality of light emission control signal generation circuits are divided into a plurality of blocks, and individual blocks are input with different light emission enable signals based on the indication signal to generate light emission control signals, there is no physical connection between an output end of one of the plurality of blocks and an input end of another one of the plurality of blocks;

if the indication signal indicates that a frame corresponding to one of the plurality of blocks is the dynamic frame, the one of the plurality of blocks is input with a modulated driving signal;

if the indication signal indicates that a frame corresponding to one of the plurality of blocks is the static frame, the one of the plurality of blocks is input with a normal driving signal; and a light emission enable portion of the modulated driving signal is shorter than a light emission enable portion of the normal driving signal.

13. The display device according to claim 12, wherein a level of a data signal in a charging phase corresponding to the dynamic frame is higher than a level of a data signal in a charging phase corresponding to the static frame.

* * * * *